United States Patent [19]

Kristiansen

[11] 4,185,410

[45] Jan. 29, 1980

[54] SLIDEABLE SUSPENSION DEVICE

[75] Inventor: Knud M. Kristiansen, Billund, Denmark

[73] Assignee: Interlego A.G., Baar, Switzerland

[21] Appl. No.: 808,038

[22] Filed: Jun. 20, 1977

[30] Foreign Application Priority Data

Jun. 29, 1976 [DK] Denmark ..... 2924/76

[51] Int. Cl.[2] ..... 463H 33/06

[52] U.S. Cl. ..... 46/23; 46/31; 248/291; 248/223.4; 248/324; 211/169.1

[58] Field of Search ..... 46/23, 16, 17, 25, 26, 46/31; 248/317, 324; 211/47, 48, 169.1, 223.4, 225.1, 291; 40/359; 24/230 BC

[56] References Cited

U.S. PATENT DOCUMENTS

| | | | |
|---|---|---|---|
| 224,806 | 2/1880 | Tapley | 281/15 A |
| 407,345 | 7/1889 | Gibbons | 281/15 A |
| 576,769 | 2/1897 | Williams | 248/291 X |
| 622,226 | 4/1899 | Homan | 248/291 X |
| 1,562,622 | 11/1925 | Dodge | 40/359 |
| 3,601,257 | 8/1971 | Potter | 312/184 X |
| 3,640,017 | 2/1972 | Christiansen | 46/23 |

FOREIGN PATENT DOCUMENTS

| | | | |
|---|---|---|---|
| 1016636 | 1/1966 | United Kingdom | 24/230 BC |

*Primary Examiner*—F. Barry Shay

*Attorney, Agent, or Firm*—Stevens, Davis, Miller & Mosher

[57] ABSTRACT

A suspension device for slideable and pivotal suspension of a base plate for toy building sets or base boards for visual planning panels. One face of the base plate or board is provided with rows of coupling studs including a plurality of studs uniformly spaced apart in both longitudinal and transverse directions, and the suspension device includes a gripping member having inwardly projecting guides adapted to slide along the base plate between a pair of rows of projections and to support the base plate when suspended on a wall. The device is further provided with a hinge member pivotally mounted on top of the gripping member, so as to provide for pivotal movements of the base plate relatively to a wall on which the base plate is mounted by means of the slideable suspension device.

4 Claims, 5 Drawing Figures

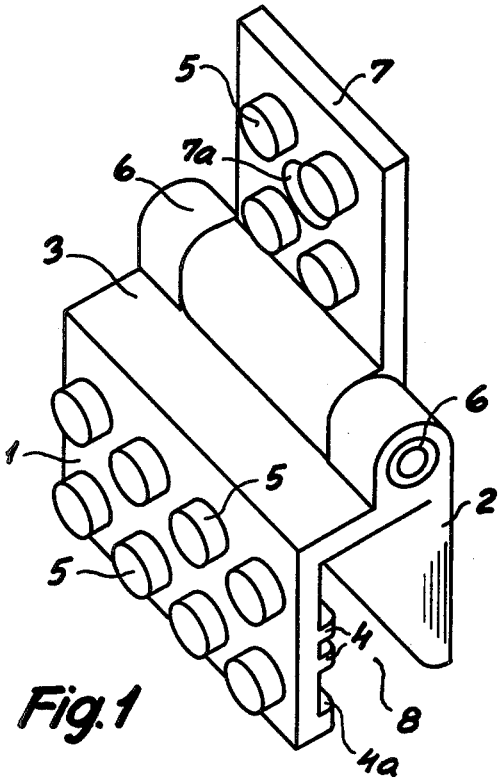
Fig.1
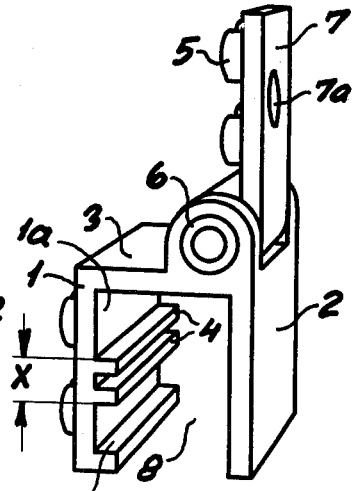
Fig.2
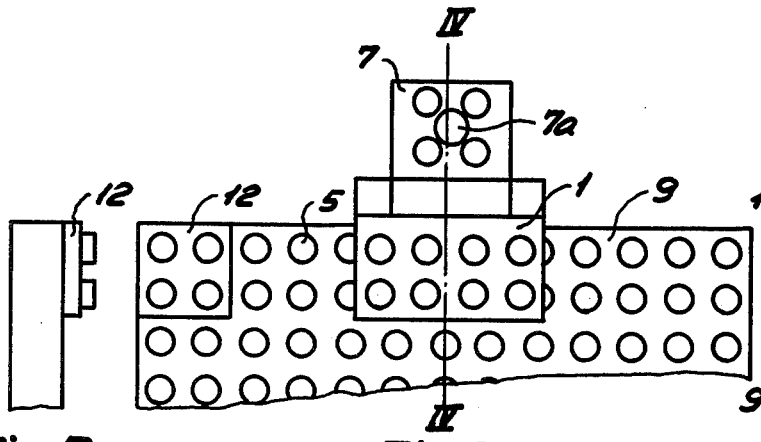
Fig.5
Fig.3
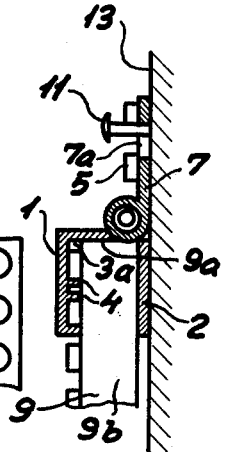
Fig.4

SLIDEABLE SUSPENSION DEVICE

This invention generally relates to a device for slideable suspension of a plate element on a wall and more particularly for suspending a plate or board with rows of identical and equidistant coupling studs at one face thereof.

Such plates are widely used as base plates in toy building sets comprising a plurality of hollow parallel sided blocks open at one face and adapted to be connected together by means of projections (primary projections) or coupling studs uniformly spaced apart in both lengthwise and transverse directions on the closed face opposite the open face of the blocks. In such building sets, the blocks are futher provided with internal projections (secondary projections) arranged within the cavity of the blocks and adapted to co-operate with the primary projections on an adjacent block for interconnecting a pair of such blocks. Similarly, the secondary projections of the blocks may be interconnected with primary projections on a base plate having a plurality of rows of primary projections or studs so that the studs on the base plate are also uniformly spaced apart in both longitudinal and transverse directions.

When suspended in a vertical position on a wall, such base plates may also be used as base boards for visual planning panels for removably mounting a plurality of blocks symbolizing various items such as dates, figures etc. in a planning system.

It is the object of the present invention to provide a device which is suitable for vertical suspension of base plates or base boards of the kind referred to and which is capable of sliding along the upper edge of the base plates to be moved into any desired position wherein it can be interlocked with the base plate. Moreover, the suspension device will also permit the base plate to be pivotally mounted so as to enable the plate to be lifted outwardly from the wall.

With this object in view, the features of the invention will now be described with reference to the embodiment shown in the drawings, wherein FIG. 1 is a perspective view showing the suspension device in one position, FIG. 2 is a similar perspective view showing details of the cavity of the suspension device, FIG. 3 is a side elevation showing the use of the device for suspension of a base plate, FIG. 4 is a sectional view taken on the line IV—IV of FIG. 3, and FIG. 5 is an end view of the uppermost part of the base plate with a locking element mounted thereon.

Referring to the drawings, the suspension device comprises a substantially box-shaped gripping member open at the bottom and at both ends. This member is defined by a front wall 1, a rear wall 2 and a top wall 3 interconnecting the front and rear walls, the walls 1, 2 and 3 defining a cavity 8 adapted to receive the upper edge of a base plate 9 as shown more clearly in FIG. 4. The dimensions of the gripping member 1, 2 and 3 are adapted to the thickness of the base plate 9 including several rows of studs 5 so as to enable this member to grip and slide along the upper edge of the base plate as hereinafter explained.

The inner face 1*a* of the front wall 1 is provided with guiding means 4 extending in the lengthwise direction of the gripping member, and the lower edge of the wall 1 is provided with similar guiding means in the form of an inwardly projecting flange 4*a*. In the embodiment shown in the drawings, the guide means 4 are a pair of parallel ribs but may also be a single rib. In fact, the slit between the two ribs shown in the drawings is merely intended to provide for saving of material. What really matters is that the height x of the ribs 4 as shown in FIG. 2 must be substantially equal to the distance between the studs 5 in a pair of adjacent rows of studs on the face of the base plate. Moreover, the ribs 4 must be so located that the distance between the lower face of the ribs 4 and the upper face of the flange 4*a* must be substantially equal to the diameter of the studs 5. On the other hand, the distance between the upper face of the ribs 4 and the inner face of the wall 3 may have to be somewhat larger than the diameter of the studs to allow the inner face 3*a* of the top wall 3 to coincide with the upper face 9*a* of the base plate as shown in FIG. 4 so as to enable the gripping member to slide along the upper face 9*a* of the base plate 9.

With this arrangement, the gripping member of the suspension device will be capable of gripping the upper edge of the base plate 9 as shown in FIG. 4 with the inner face of the rear wall 2 abutting the rear wall 9*b* of the base plate and the inner face 1*a* of the front wall 1 abutting the top faces of the studs 5. The upper part of the base plate 9 will thus be suspended in the suspension device by means of the ribs 4 between a pair of adjacent rows of studs 5 on the base plate 9. Moreover, the suspension is such that the suspension device is slideable along the upper edge of the base plate 9 to any desired position relatively thereto. In such positions, the suspension device may be locked between a pair of blocks 12, one of which is shown in FIGS. 3 and 5. The block 12 may be a standard element adapted to be clamped on the studs 5 of the base plate.

In order to provide for swingable mounting of the suspension device on a wall 13 as shown in FIG. 4, a hinge member 7 is pivotally mounted on the top wall 3 in bearings 6. As shown in the drawings, this hinge member 7 is provided with a hole or aperture 7*a* for inserting a pin or nail 11 as shown in FIG. 4. Finally, the hinge member 7 and also the outer face of the front wall 1 may be provided with coupling studs 5 corresponding to the studs 5 on the base plate for connecting elements of toy building blocks when using the device as an element in a toy building set.

What I claim is:

1. A suspension device for slideable and pivotal suspension of a base plate, one face of which is provided with a plurality of studs uniformly spaced apart in both longitudinal and transverse directions, so as to form a plurality of adjacent rows, said device comprising a substantially box-shaped gripping member having a front wall, a rear wall and an intermediate top wall defining a cavity open at the bottom and at both ends with said front and rear walls being in fixed relationship; guide means comprising at least one longitudinally extending flange projecting inwardly into said cavity from the inner face of the front wall intermediate the top wall and the open bottom of the gripping member, so as to provide a lengthwise extending channel adapted to receive one row of studs adjacent one edge of a base place slideably mounted in said cavity; bearing means formed integrally with the top wall and defining an axis of rotation for said cavity extending in the lengthwise direction of the gripping member adjacent the top edge thereof; a hinge member pivotally mounted to said bearing means for swinging movement of the gripping member relatively to the hinge member around said axis of rotation.

2. A display device having a slideably and pivotally suspended base plate comprising in combination a base plate, one face of which is provided with a plurality of studs uniformly spaced apart in both longitudinal and transverse directions, so as to form a plurality of adjacent rows, and a suspension device comprising a substantially box-shaped gripping member having a front wall, a rear wall and an intermediate top wall defining a cavity open at the bottom and at both ends; guide means comprising at least one longitudinally extending flange projecting inwardly into said cavity from the inner face of the front wall intermediate the top wall and the open bottom of the gripping member, so as to provide a lengthwise extending channel to receive one row of studs adjacent one edge of the base plate slideably mounted in the cavity of the gripping member, the width of the cavity and the distance between the guide means flange and the inner face of the top wall being such as to enable the base plate to be slideable within the cavity with one row of studs between the upper face of the guide flange and the inner face of the top wall; bearing means formed integrally with the top wall and defining an axis of rotation extending in the lengthwise direction of the gripping member adjacent the top edge thereof and a hinge member pivotally mounted to said bearing means for swinging movement of the gripping member and base plate relatively to the hinge member around said axis of rotation.

3. A display device, as claimed in claim 2, in which the inner face of the front wall of the gripping member has an inwardly and longitudinally extending guide flange along the lower edge thereof, so as to enable the gripping member to grip two rows of studs adjacent one edge of the base plate.

4. A display device, as claimed in claim 2, including at least one block removably clamped on the studs of the base plate adjacent the upper edge thereof for limiting the transverse displacement of the gripping member relatively to the base plate.

* * * * *